US006227133B1

(12) United States Patent
Gross

(10) Patent No.: US 6,227,133 B1
(45) Date of Patent: May 8, 2001

(54) MARINE RAW WATER MANIFOLD

(76) Inventor: Donald Gross, 7240 Standard Dr., Queenstown, MD (US) 21076

( * ) Notice: Subject to any disclaimer, the term of this patent is extended or adjusted under 35 U.S.C. 154(b) by 0 days.

(21) Appl. No.: 09/475,764

(22) Filed: Dec. 30, 1999

(51) Int. Cl.[7] ..... B63B 13/00
(52) U.S. Cl. ..... 114/198; 440/88; 210/108
(58) Field of Search ..... 440/88, 179, 182, 440/183 R, 198; 210/108

(56) References Cited

U.S. PATENT DOCUMENTS

| | | | | |
|---|---|---|---|---|
| 2,350,598 | * | 6/1944 | Faville | 114/198 |
| 4,061,571 | * | 12/1977 | Banner | 114/198 |
| 4,915,017 | | 4/1990 | Perlov | 92/5 R |
| 5,009,251 | | 4/1991 | Pike et al. | 137/601 |
| 5,034,124 | | 7/1991 | Kopf | 210/231 |
| 5,195,428 | | 3/1993 | Gawlitta et al. | 100/73 |
| 5,240,854 | | 8/1993 | Berry et al. | 435/284 |
| 5,275,201 | | 1/1994 | Zimmerly | 137/454.6 |
| 5,337,615 | | 8/1994 | Goss | 73/861.33 |
| 5,471,835 | | 12/1995 | Friedman | 60/293 |
| 5,833,503 | * | 11/1998 | Kallio | 440/88 |

* cited by examiner

*Primary Examiner*—Jesus D. Sotelo
(74) *Attorney, Agent, or Firm*—Pearne & Gordon LLP

(57) ABSTRACT

A manifold system for supplying water to two or more consumer devices on a marine vessel having a primary consumer and one or more secondary consumers has a primary conduit connectable to the primary consumer, the conduit having an interior cross-sectional area determined by water requirements of the primary consumer. A manifold has a threaded inlet fitting, a primary outlet fitting dimensioned to be connectable to the conduit, and a plurality of secondary outlet fittings connectable to secondary conduits for secondary consumers. The inlet and secondary outlet fittings of the manifold have cross-sectional areas determined by dimensions of the primary outlet fitting. A strainer has an inlet connected to a through-hull fitting for receiving and straining incoming raw water and an outlet having a threaded connector for attachment to the manifold inlet fitting, the strainer having a flow capacity determined by the diameter of the strainer outlet. The cross-sectional area of the manifold inlet is larger than the combined cross-sectional areas of the primary outlet fitting and the secondary outlet fittings and is determined by the cross-sectional area of the primary outlet fitting.

3 Claims, 2 Drawing Sheets

MARINE RAW WATER MANIFOLD

FIELD OF THE INVENTION

This invention relates to a manifold system for a marine vessel which provides fitting for safely connecting the output of a strainer to multiple water-using devices and guarantees that none of the devices receives inadequate water flow.

BACKGROUND OF THE INVENTION

In a marine vessel, it is not unusual to draw water into the vessel through a through-hull fitting for use, for example, as cooling water for an engine or for other purposes. The water is normally conducted through a strainer and then is piped to the engine or other device.

Whenever water is drawn in in this fashion, it is important to be sure that the water flow is adequate for the consumer, i.e., for the article using the water. If the consumer is the engine, it is essential for the flow to be adequate for the engine's needs to avoid possible severe damage to the engine. The same is true for other devices such as an air conditioning pump, generator, deckwash pump, desalination pump or the like. While the engine is obviously the most critical consumer, and generally uses more water than other devices, providing inadequate flow to any of the consumers can result in damage requiring expensive repairs.

Because of the critically of this flow, the use of a manifold is avoided. While a manifold could theoretically be used to provide water to an engine and also to two or more other devices, it is has been considered dangerous to do so because, if a manifold is used, it is possible for an installer of the equipment to select improper sizes of hoses or pipes to the engine and other consumers, allowing too little flow to the engine or one or more of the other devices. Thus, water is often drawn in through more than one through-hull fitting, one for each water consumer. While this works, it causes additional expense and additional openings through the hull, both of is which are undesirable.

SUMMARY OF THE INVENTION

Briefly described, the invention comprises a manifold system for supplying water to a plurality of consumer devices on a marine vessel, the vessel having a primary consumer and a plurality of secondary consumers. A primary conduit leads to the primary consumer, the primary conduit having an interior cross-sectional area determined by water requirements of the primary consumer. A manifold has a threaded inlet fitting, a primary outlet fitting dimensioned to be connectable to the primary conduit, and a plurality of secondary outlet fittings connectable to secondary conduits for secondary consumers, the manifold having a cross-sectional area determined by dimensions of said primary outlet fitting A strainer has an inlet connected to a through-hull fitting for receiving and straining incoming raw water and an outlet having a threaded connector for attachment to the manifold inlet fitting, the strainer having a flow capacity determined by the diameter of the strainer outlet, the cross-sectional area of the manifold inlet being larger than the combined cross-sectional areas of the primary conduit and the secondary conduits and being determined by the cross-sectional area of the primary conduit so that the strainer and manifold always have sufficient flow capacity to supply the water needs of the primary and secondary consumers.

BRIEF DESCRIPTION OF THE DRAWINGS

In order to impart full understanding of the manner in which various advantages and features are attained in accordance with the invention, particularly advantageous embodiments thereof will be described with reference to the following drawings, which form a part of this disclosure, and herein.

DESCRIPTION OF PREFERRED EMBODIMENTS

Figure 1:
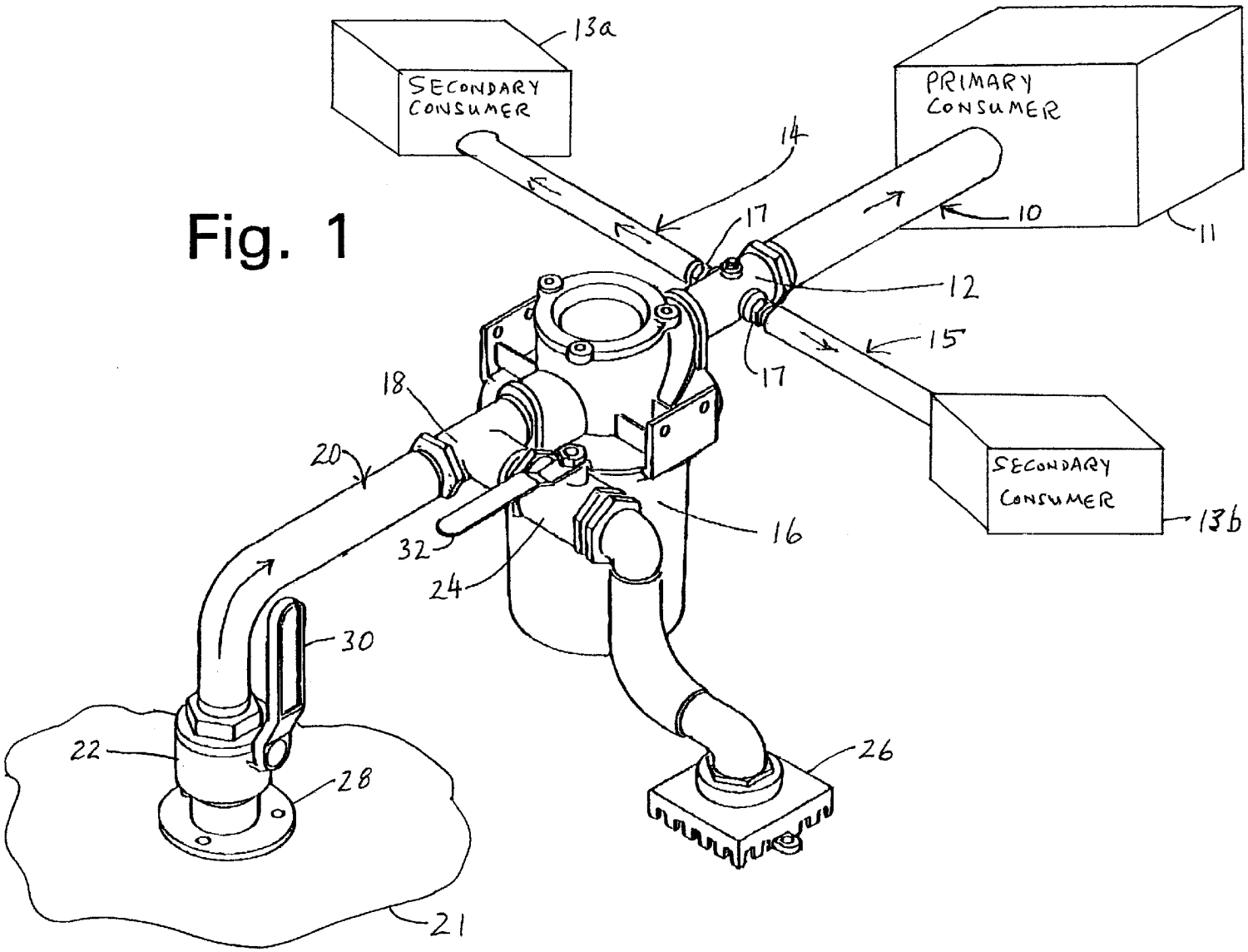
FIG. 1 is a perspective view of an inlet, strainer and manifold system in accordance with the invention.
Figure 2:
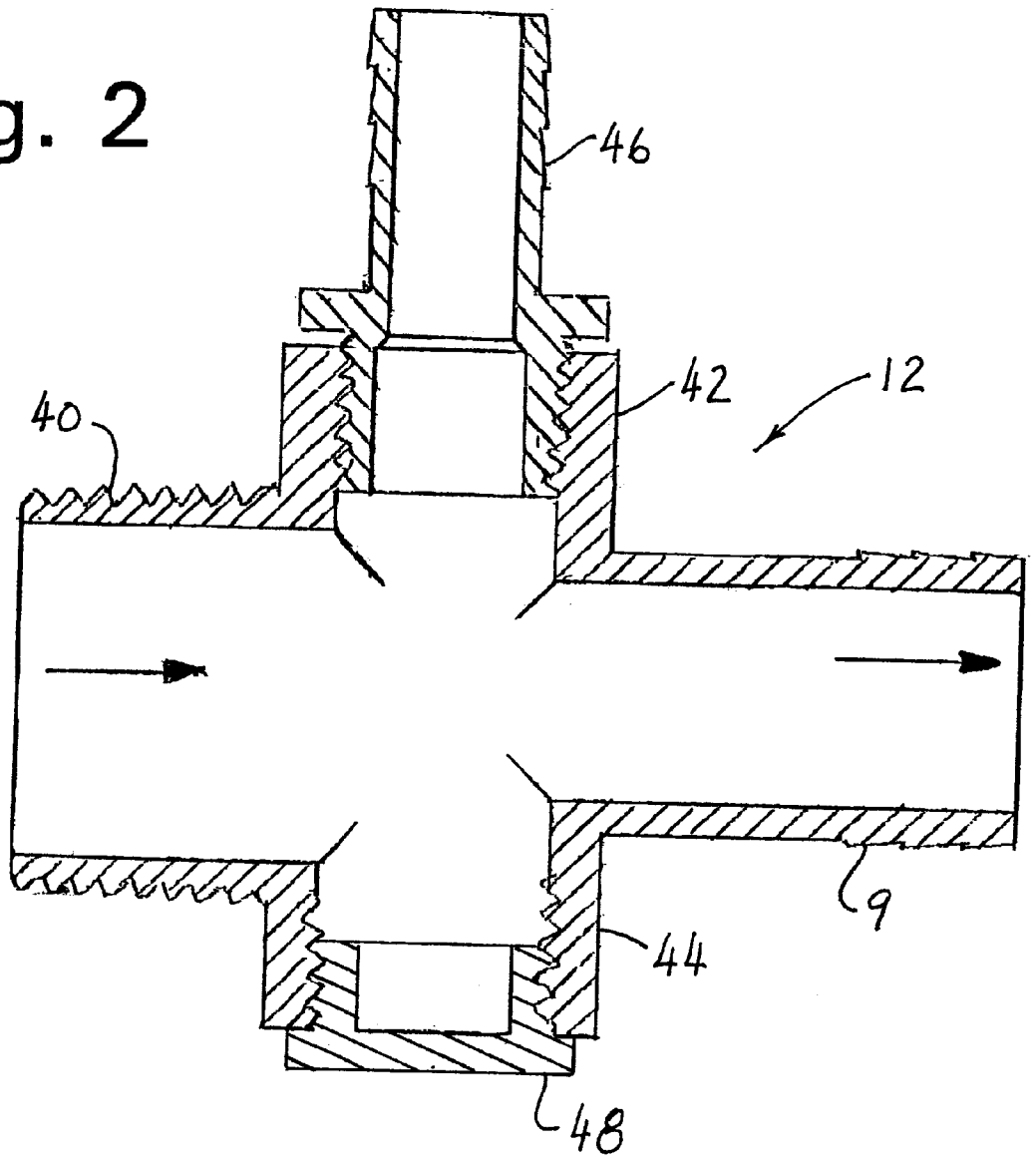
FIG. 2 is a schematic plan view, in section, showing the details of relative dimensions and connections of the manifold of FIG. 1.

FIGS. 1 and 2 show a system including the features of the present invention. The system of FIG. 1 includes a hose 10 which delivers cooling water to a primary consumer 11 such as an engine from a raw water manifold 12. The primary consumer includes a pump, not shown, to draw water through the system shown. Manifold 12 has an outlet end with a barbed hose connection 9 connected to hose 10. Manifold 12 also has outlets 17 which may be connected to hoses 14 and 15 which deliver water to other possible secondary consumers 13*a* and 13*b* which may be any of those mentioned above, or other devices. The secondary consumers also have, or are, pumps to draw water through the manifold.

An inlet end of manifold 12 is threaded for connection to the outlet of a raw water strainer 16 which has an inlet connected to a safety seacock conversion 18. The seacock conversion has one inlet connected through a hose 20 to a valved seacock 22 and another inlet connected through a valve 24 to a bilge strainer 26. Seacock 22 has a flange 28 connected to an opening through the hull 21 of the vessel and forms the through-hull fitting providing the cooling water for the engine as well as water needed for the other water consumers on the vessel. Normally, the seacock valve is in the open position as illustrated by the position of valve handle 30 in the figure. The valve handle can be moved 90° to close the valve which is a conventional gate or ball valve.

Valve 24 is normally closed, as shown by the position of valve handle 32 in the figure, but can be opened by moving the handle 90° to permit water to enter through the bilge strainer, particularly if the vessel has taken on water, in which case the bilge water supplements the water taken in through seacock 22.

Raw water strainer 16 is a device which is conventional in the sense that it is a standard kind of device to include in a water inlet system for a vessel using raw water for cooling and other purposes. It is extremely important to strain from the incoming water as much solid material as possible, including small creatures living in the water, and it is important to use a strainer which has sufficient flow capacity to supply all consumers on the vessel. In accordance with the invention, the size of the strainer as well as the sizes of all other fittings associated with direct water supply are determined by the inlet hose for the primary consumer. Based on this size, the other components are dimensioned so that the person who is doing the installing is essentially forced to install the proper components.

As shown in greater detail in FIG. 2, the manifold 12 includes an externally threaded inlet end 40 with NPT threads for connection to strainer 16, the diameter of the inlet end being chosen in accordance with the principles discussed below. The primary outlet end of the manifold comprises the barbed outlet 9. Secondary outlet ports 42 and 44 are internally threaded to receive either a barbed hose fitting 46, shown threaded into port 42, or an externally threaded plug 48, as shown in port 44, if the port is not to be used.

For the following example, we will start with the primary consumer and work backwards through the system. If the primary consumer is a marine engine, it has a raw water pump which has been selected by the engine manufacturer to supply a predetermined flow in GPM (gallons per minute) adequate to meet the engine's cooling requirements. There are many engine sizes and therefore many sizes of strainer and seacocks to match. The engine pump dictates the size requirements for the other components in the system. Hence, if the engine pump requires 1.25 inch flow, in a prior art system not using a manifold, the strainer and seacock would also be 1.25 inch so that the flow could be adequate to supply the engine. However, the present invention supplies other consumers as well, so a 1.25 inch inlet would not be adequate and would starve one or more of the consumers of cooling water.

Using as an example the system depicted in FIG. 1 with a manifold according to FIG. 2, we will assume that the primary consumer requires that hose 10 have an inner diameter of 1.25 inches. A raw water manifold such as that shown would need to have a 1.25 inch hose barbed outlet. Therefore, the manifold which is used is a Groco model RWM-1500 manifold which has a 1.5 inch NPT National Pipe Thread) inlet. This requires that the installer use a strainer with 1.5 inch NPT ports, a larger strainer than would normally be chosen. "NPT" refers to a standard kind of pipe thread which is tapered to form a seal with the threads of a mating part. In the example, the top of seacock 22, the strainer inlet and the threaded connections of manifold 12 all use NPT threads so that a seal is provided when they are screwed together.

The 1.5 inch strainer is supplied with water through a 1.5 inch NPT pipe 44 which has an ID of 1.5 inches and a cross-sectional area of 1.7671 square inches. Thus, the manifold has a 1.5 inch ID inlet. From this is supplied a 1.25 inch hose barb 9, which has an inside diameter of 1 inch and a cross-section of .7854 square inches, and two .75 inch hose barbs 46, each having an ID of 0.5 inch and a cross-section of .4418 square inches.

The sum of the cross-sectional areas of the three consumer ports is 1.669 square inches which is significantly less than the 1.7671 square inch cross-sectional area of the 1.5 inch inlet end of the manifold, which assures that flow will not be restricted to any of the consumers.

Thus, by requiring that the installer properly select the sizes for the inlet and output connectors of the manifold and strainer, the invention essentially assures that the installer will assemble a system which provides adequate flow to multiple consumers, even though the installer may not understand the requirements for such a system.

It will be apparent from the above that, for any primary consumer flow requirement, in accordance with the invention it is possible to choose a manifold in which the cross-sectional area of the manifold inlet exceeds the sum of the cross-sectional areas of the manifold outputs, thereby necessitating the use of a strainer and seacock large enough to supply the need of all consumers connected to the manifold. By following the principles discussed herein, a manifold can be selected to safely supply any size engine or other primary consumer along with the secondary consumers connected to the manifold.

While one advantageous embodiment has been chosen to illustrate the invention, it will be understood by those skilled in the art that various modifications can be made therein without departing from the scope of the invention as defined in the appended claims.

What is claimed:

1. A manifold system for supplying water to a plurality of consumer devices on a marine vessel having a primary consumer and a plurality of secondary consumers, the system comprising:

a primary conduit connectable to a primary consumer, said conduit having an interior cross-sectional area determined by water requirements of said primary consumer;

a manifold having a threaded inlet fitting, a primary outlet fitting dimensioned to be connectable to said conduit, and a plurality of secondary outlet fittings connectable to secondary conduits for secondary consumers, said inlet and secondary outlet fittings of said manifold having cross sectional areas determined by dimensions of said primary outlet fitting; and a strainer having an inlet connected to a through-hull fitting for receiving and straining incoming raw water and an outlet having a threaded connector for attachment to said manifold inlet fitting, said strainer having a flow capacity determined by a diameter of said strainer outlet, said cross-sectional area of said manifold inlet being larger than the combined cross-sectional areas of said primary outlet fitting and said secondary outlet fittings and being determined by said cross-sectional area of said primary outlet fitting.

2. A system according to claim 1 wherein said manifold has two secondary outlet fittings, one primary outlet fitting and an inlet fitting, and wherein the ratio of inlet fitting cross sectional area to primary outlet fitting cross sectional area is greater than two.

3. A system according to claim 2 wherein the ratio of inlet fitting cross-sectional area to cross-sectional area of one secondary outlet fitting is greater than 8.8.

* * * * *